US010184345B2

(12) United States Patent
Himes

(10) Patent No.: US 10,184,345 B2
(45) Date of Patent: Jan. 22, 2019

(54) COVER PLATE ASSEMBLY FOR A GAS TURBINE ENGINE

(71) Applicant: UNITED TECHNOLOGIES CORPORATION, Farmington, CT (US)

(72) Inventor: Jason D. Himes, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 327 days.

(21) Appl. No.: 14/909,215

(22) PCT Filed: Aug. 4, 2014

(86) PCT No.: PCT/US2014/049538

§ 371 (c)(1),
(2) Date: Feb. 1, 2016

(87) PCT Pub. No.: WO2015/020931

PCT Pub. Date: Feb. 12, 2015

(65) Prior Publication Data

US 2016/0186590 A1 Jun. 30, 2016

Related U.S. Application Data

(60) Provisional application No. 61/864,043, filed on Aug. 9, 2013.

(51) Int. Cl.
*F01D 11/00* (2006.01)
*F04D 29/32* (2006.01)
(Continued)

(52) U.S. Cl.
CPC ..... *F01D 11/006* (2013.01); *F01D 5/3015* (2013.01); *F04D 29/083* (2013.01); *F04D 29/322* (2013.01); *F01D 11/001* (2013.01); *F05D 2220/32* (2013.01); *F05D 2230/60* (2013.01); *F05D 2240/80* (2013.01); *F05D 2260/30* (2013.01)

(58) Field of Classification Search
CPC .... F01D 11/006; F01D 11/001; F01D 5/3015; F04D 29/322; F04D 29/083; F05D 2260/30
USPC ..... 416/220 R, 204 A, 244 A
See application file for complete search history.

(56) References Cited

U.S. PATENT DOCUMENTS 3,096,074 A * 7/1963 Pratt ..... F01D 5/3015 416/215
3,300,179 A 1/1967 Gooderum
(Continued)

OTHER PUBLICATIONS

International Search Report and Written Opinion of the International Searching Authority for International application No. PCT/US2014/049538 dated Feb. 16, 2015.
(Continued)

*Primary Examiner* — Jason Shanske
*Assistant Examiner* — Topaz L Elliott
(74) *Attorney, Agent, or Firm* — Carlson, Gaskey & Olds, P.C.

(57) ABSTRACT

A cover plate assembly according to an exemplary aspect of the present disclosure includes, among other things, a first cover plate and a second cover plate in contact with a portion of the first cover plate to at least axially retain the first cover plate.

18 Claims, 5 Drawing Sheets

(51) Int. Cl.
*F04D 29/08* (2006.01)
*F01D 5/30* (2006.01)

(56) References Cited

U.S. PATENT DOCUMENTS 4,192,633 A 3/1980 Herzner
4,473,337 A 9/1984 Leonardi et al.
4,659,285 A 4/1987 Kalogeros et al.
5,277,548 A 1/1994 Klein et al.
5,320,492 A * 6/1994 Bouru ..... F01D 5/3015 416/220 R
5,800,124 A * 9/1998 Zelesky ..... F01D 5/081 416/95
5,993,160 A 11/1999 Bouchard et al.
6,884,028 B2 * 4/2005 Brauer ..... F01D 5/3015 415/173.7
7,371,050 B2 * 5/2008 Pasquiet ..... F01D 5/3015 416/204 A
7,484,936 B2 * 2/2009 Bouchard ..... F01D 11/006 415/173.3
8,206,119 B2 6/2012 Liotta et al.
8,277,191 B2 10/2012 Ammann
8,313,289 B2 11/2012 Caprario et al.
9,181,810 B2 * 11/2015 Dimmick, III ..... F01D 5/3015
9,605,552 B2 * 3/2017 Wondrasek ..... F01D 11/006
2004/0062643 A1 4/2004 Brauer et al.
2005/0123405 A1 6/2005 Ono et al.
2007/0258816 A1 11/2007 Bouchard et al.
2009/0004012 A1 1/2009 Caprario et al.
2009/0148295 A1 6/2009 Caprario et al.
2010/0215501 A1 8/2010 Ammann
2012/0082568 A1 * 4/2012 Tibbott ..... F01D 5/081 416/97 R
2013/0108462 A1 5/2013 Harris, Jr. et al.
2013/0156589 A1 * 6/2013 Paquet ..... F01D 5/3015 416/220 R
2015/0369062 A1 * 12/2015 Tanaka ..... F01D 11/003 415/208.1
2016/0290142 A1 * 10/2016 Hough ..... F01D 5/3015

OTHER PUBLICATIONS

Internaltional Preliminary Report on Patentability for PCT Application No. PCT/US2014/049538, dated Feb. 18, 2016.

* cited by examiner

COVER PLATE ASSEMBLY FOR A GAS TURBINE ENGINE

BACKGROUND

This disclosure relates to a gas turbine engine, and more particularly to a cover plate assembly for a gas turbine engine rotor assembly. The cover plate assembly employs a first, segmented cover plate used in conjunction with a second, full hoop cover plate.

Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor section and the turbine section may each include alternating rows of rotor and stator assemblies. The rotor assemblies carry rotating blades that create or extract energy (in the form of pressure) from the core airflow that is communicated through the gas turbine engine. The stator assemblies include stationary structures called stators or vanes that direct the core airflow to the blades to either add or extract energy.

Rotor assemblies typically include rotor disks that extend between disk rims and disk bores. The blades are mounted near the rim of a rotor disk. The disk rims and portions of the blades may require sealing to prevent hot gas ingestion. Cover plates are sometimes used to seal the connection between the blades and the rotor disks that carry the blades.

SUMMARY

A cover plate assembly according to an exemplary aspect of the present disclosure includes, among other things, a first cover plate and a second cover plate in contact with a portion of the first cover plate to at least axially retain the first cover plate.

In a further non-limiting embodiment of the foregoing cover plate assembly, the cover plate assembly is part of a turbine assembly or a compressor assembly.

In a further non-limiting embodiment of either of the foregoing cover plate assemblies, the first cover plate includes a body that extends between a radially outer portion and a radially inner portion and a ledge or tab located between the radially outer portion and the radially inner portion.

In a further non-limiting embodiment of any of the foregoing cover plate assemblies, the second cover plate includes a body having a mid-section that extends between a radially outer portion and a retaining leg.

In a further non-limiting embodiment of any of the foregoing cover plate assemblies, the second cover plate includes a radially outer portion that applies a force against a radially inner portion of the first cover plate to axially retain the first cover plate.

In a further non-limiting embodiment of any of the foregoing cover plate assemblies, a portion of the first cover plate is axially trapped by a lip of the second cover plate.

In a further non-limiting embodiment of any of the foregoing cover plate assemblies, one of the first cover plate and the second cover plate abuts a ledge of the other of the first cover plate and the second cover plate to radially retain the first cover plate.

In a further non-limiting embodiment of any of the foregoing cover plate assemblies, a radially outer portion of the first cover plate abuts a platform of a blade.

In a further non-limiting embodiment of any of the foregoing cover plate assemblies, the radially outer portion is received within a groove of the platform.

In a further non-limiting embodiment of any of the foregoing cover plate assemblies, the first cover plate is segmented and the second cover plate is a full hoop.

A gas turbine engine according to an exemplary aspect of the present disclosure includes, among other things, a rotor disk, a blade that extends from the rotor disk and a first cover plate positioned relative to a portion of the blade. A second cover plate is positioned relative to the rotor disk and extends radially inward from the first cover plate.

In a further non-limiting embodiment of the foregoing gas turbine engine, the first cover plate is a segmented cover plate and the second cover plate is a full hoop cover plate.

In a further non-limiting embodiment of either of the foregoing gas turbine engines, the first cover plate is positioned relative to a platform of the blade.

In a further non-limiting embodiment of any of the foregoing gas turbine engines, a retaining ring is between the second cover plate and the rotor disk.

In a further non-limiting embodiment of any of the foregoing gas turbine engines, the first cover plate is radially outward of a rim of the rotor disk.

A method according to another exemplary aspect of the present disclosure includes, among other things, axially retaining a first cover plate relative to a blade of a gas turbine engine with a second cover plate and radially retaining the first cover plate with a portion of the blade.

In a further non-limiting embodiment of the foregoing method, the first cover plate is a segmented cover plate and the second cover plate is a full hoop cover plate.

In a further non-limiting embodiment of either of the foregoing methods, the step of radially retaining the first cover plate includes positioning a portion of the first cover plate into a groove of a platform of the blade.

In a further non-limiting embodiment of any of the forgoing methods, the step of axially retaining includes exerting a force against the first cover plate with a portion of the second cover plate.

In a further non-limiting embodiment of any of the forgoing methods, the step of radially retaining the first cover plate includes abutting a portion of the second cover plate against a ledge of the first cover plate.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to a cover plate assembly for a gas turbine engine rotor assembly. The exemplary cover plate assembly may be used to seal the connection between the blades and rotor disks of the rotor assembly. As detailed herein, among other features, the cover plate assembly described in this disclosure may employ a first, segmented cover plate in combination with a second, full hoop cover plate.

Figure 1:
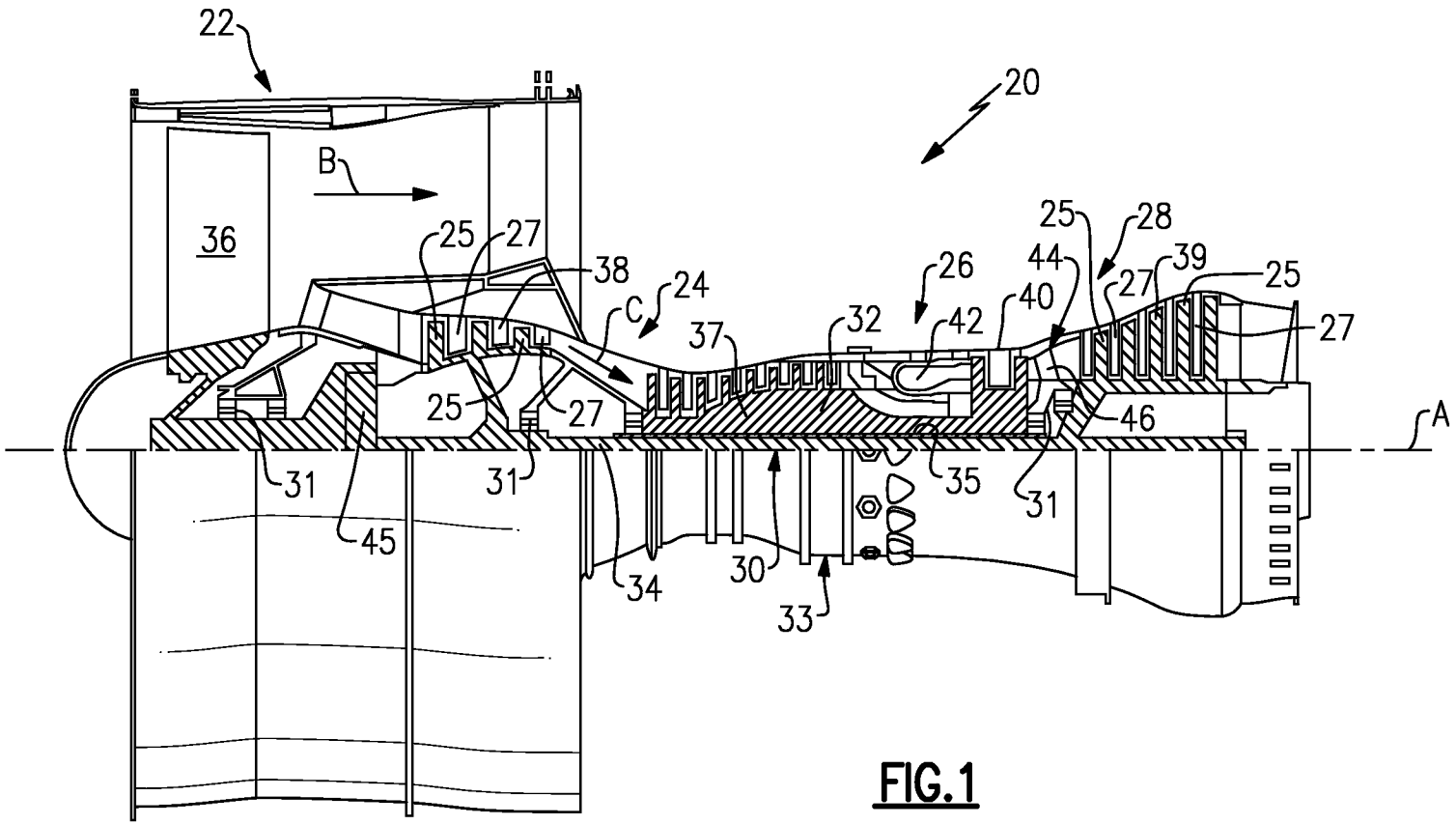
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

The compressor section 24 and the turbine section 28 may include alternating rows of rotor assemblies and stator assemblies (shown schematically) that carry airfoils. For example, rotor assemblies carry a plurality of rotating blades 25, while stator assemblies carry stationary stators 27 (or vanes) that extend into the core flow path C to influence the hot combustion gases. The blades 25 create or extract energy (in the form of pressure) from the core airflow that is communicated through the gas turbine engine 20 along the core flow path C. The stators 27 direct the core airflow to the blades 25 to either add or extract energy.

Figure 2:
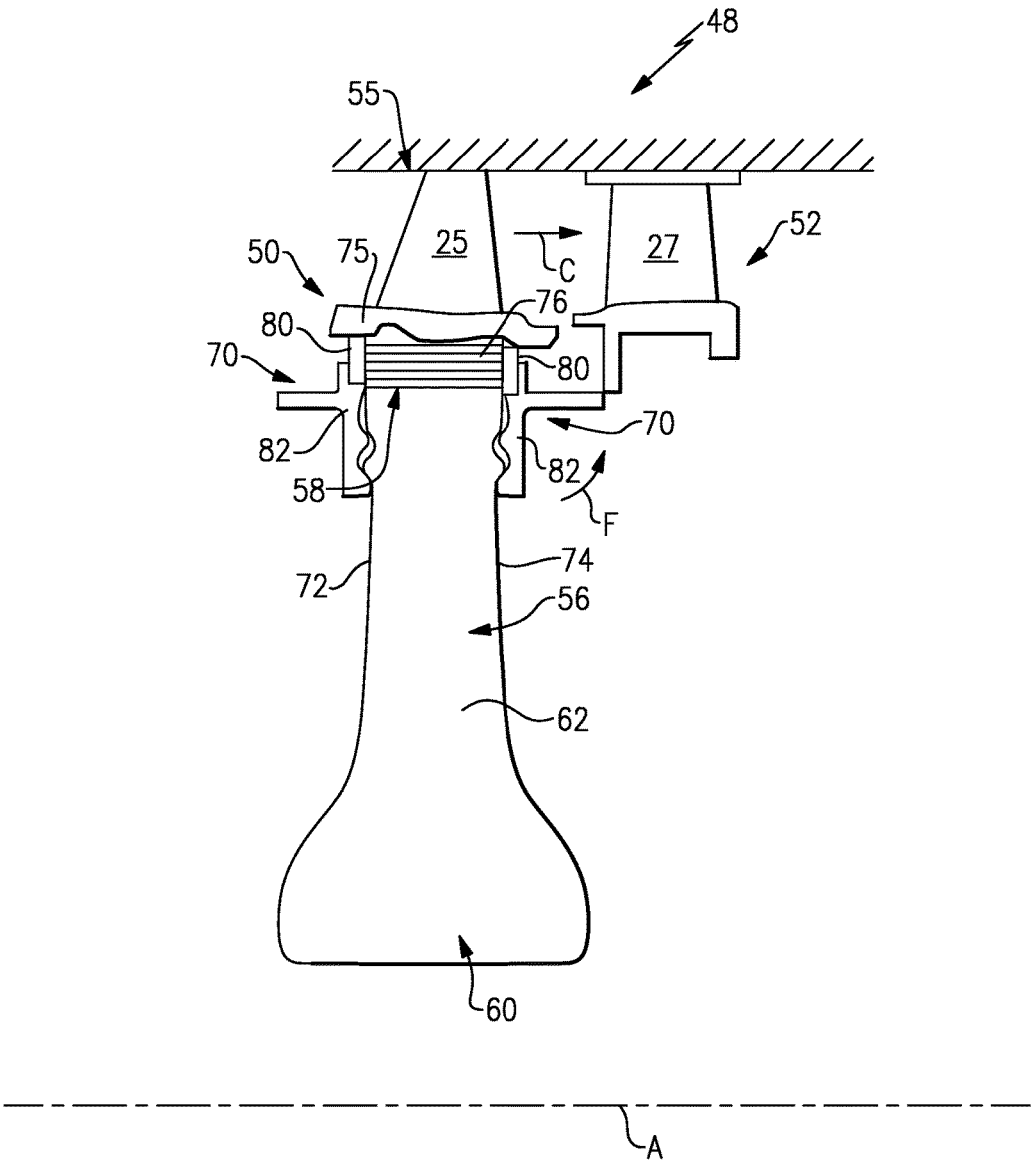
FIG. 2 illustrates a cross-sectional view of a portion of a gas turbine engine.

FIG. 2 schematically illustrates a portion 48 of a gas turbine engine, such as the gas turbine engine 20 of FIG. 1. In one embodiment, the portion 48 is a turbine assembly of the turbine section 28 of the gas turbine engine 20. However, this disclosure is not limited to turbine assemblies, and the various features of this disclosure could extend to other assemblies or sections of the gas turbine engine 20, including but not limited to compressor assemblies. In addition, it should be appreciated that the portion 48 is not necessarily drawn to scale and has been enlarged to better illustrate its various features and components.

In one embodiment, the portion 48 includes a rotating rotor assembly 50 and a stationary stator assembly 52. Of course, additional stages of rotor and stator assemblies may be employed within the portion 48. The rotor assemblies 50 carry blades 25, while the stator assemblies 52 include stators 27. Each row of blades 25 and stators 27 is circumferentially disposed about the engine centerline longitudinal axis A.

The blades 25 of the rotor assembly 50 are circumferentially disposed about a rotor disk 56 that rotates about the engine centerline longitudinal axis A to move the blades 25 and thereby channel core gases along the core flow path C. The rotor disk 56 includes a rim 58, a bore 60 and a web 62 that extends between the rim 58 and the bore 60. The blades 25 are carried by slots (not shown) formed in the rim 58 of the rotor disk 56 and extend radially outwardly toward an engine casing 55. The blades 25 include a platform 75 that establishes a radially inner flow boundary of the core flow path C and a root 76 that can be inserted into a slot in the rim 58 of the rotor disk 56.

A cover plate assembly 70 (shown schematically in FIG. 2) may be positioned at one or both of a first surface 72 (on an upstream side) and a second surface 74 (at a downstream side) of the rotor disk 56. In one embodiment, the cover plate assembly 70 includes a first cover plate 80 and a second cover plate 82 at least partially in contact with the first cover plate 80. The first cover plate 80 may be positioned relative to the blade 25, whereas the second cover plate 82 may extend radially inward from the blades 25 substantially along one or both of the surfaces 72, 74 of the rotor disk 56.

The cover plate assembly 70 seals the connection between the blades 25 and the rotor disk 56 of the rotor assembly 50. For example, the cover plate assembly 70 may form an annular seal between the core flow path C and a secondary cooling flow path F that is radially inward from the core flow path C. The secondary cooling flow path F communicates cooling fluid to cool portions of a rotor assembly 50, including but not limited to the rim 58, the bore 60, and the web 62 of the rotor disk 56 as well as portions of the blades 25, such as the platform 75 and the root 76. In addition to sealing, the cover plate assembly 70 may axially retain the blades 25 to the rotor disk 56.

Figure 3:
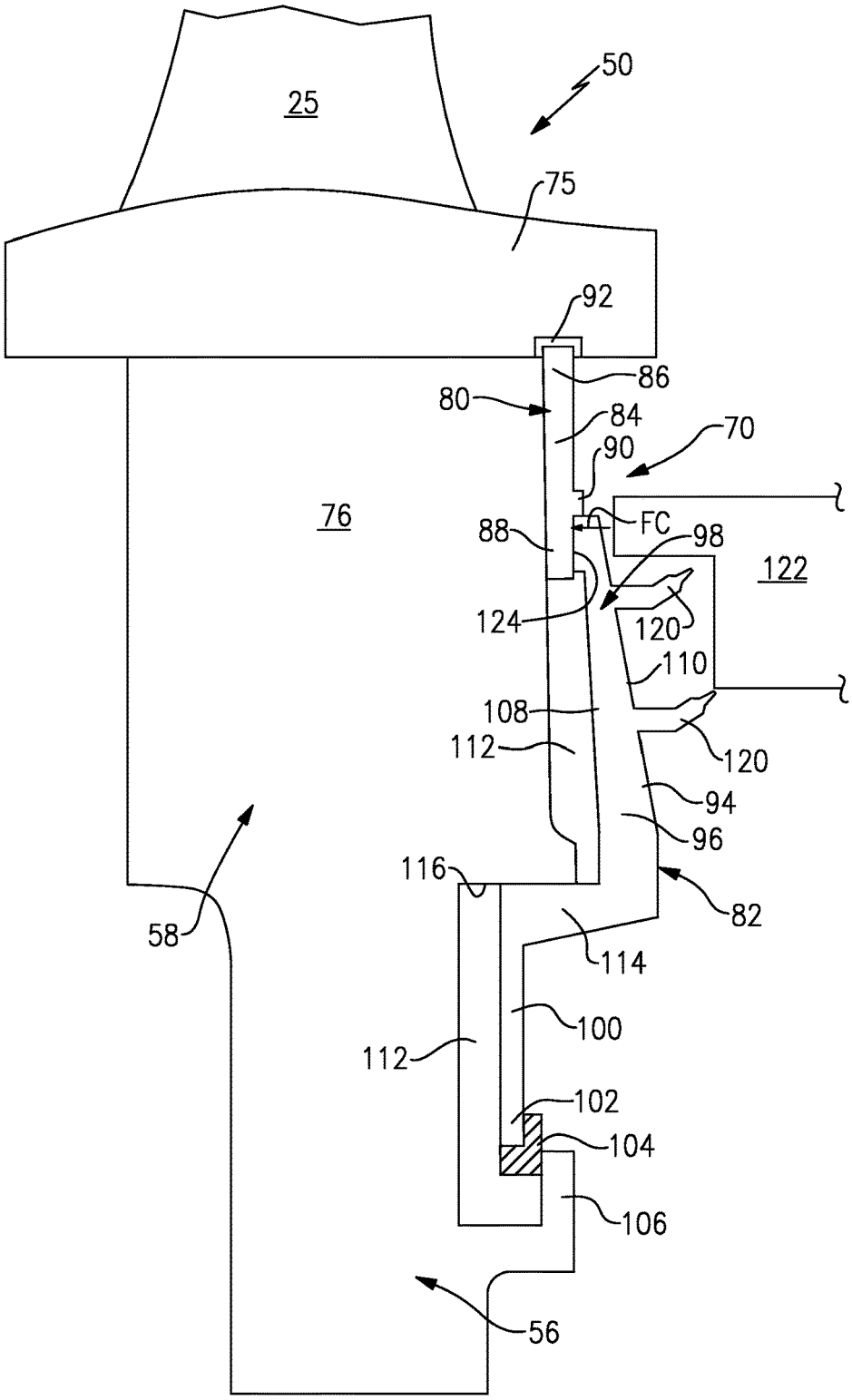
FIG. 3 illustrates a cover plate assembly of a rotor assembly of a gas turbine engine.

A first non-limiting embodiment of a cover plate assembly 70 that may be incorporated into a rotor assembly 50 is illustrated by FIG. 3. The cover plate assembly 70 includes a first cover plate 80 and a second cover plate 82. In one embodiment, the first cover plate 80 is a segmented cover plate and the second cover plate 82 is a full hoop cover plate. In other words, the first cover plate 80 is a discrete section configured to seal a single blade 25 or a section of blades 25 (see, for example, FIGS. 4A and 4B). In contrast, the second cover plate 82 is configured to annularly extend about the engine centerline longitudinal axis A (see FIGS. 1 and 2) in much the same way as the annularly disposed rotor disk 56.

In general, the segmented, first cover plate 80 is less susceptible to thermo-mechanical fatigue (TMF) as compared to the full hoop, second cover plate 82. Therefore, in one embodiment, first cover plate 80 can be positioned to seal the higher temperature portions (e.g., outboard of the rim 58) of the rotor assembly 50 and the full hoop, second cover plate 82 can be positioned to seal inboard portions of the rotor assembly 50 that may be susceptible to less extreme temperatures (e.g., inboard of the rim 58).

In one embodiment, the first cover plate 80 includes a body 84 that extends between a radially outer portion 86 and a radially inner portion 88. A ledge 90 may extend across the body 84 between the radially outer portion 86 and the radially inner portion 88. In another embodiment, the ledge 90 includes a plurality of circumferentially spaced tabs.

The first cover plate 80 is positioned relative to the blade 25. In one embodiment, the first cover plate 80 is positioned radially outward from the rim 58 of the rotor disk 56 such that the entirety of the body 84 is received against only the platform 75 and the root 76 of the blade 25. The radially outer portion 86 of the first cover plate 80 may be received within a groove 92 formed in the platform 75 of the blade 25. This radially retains the first cover plate 80 in the radially outward direction. The second cover plate 82 axially retains the first cover plate 80 against the blade 25, as further discussed below.

In one embodiment, the second cover plate 82 includes a body 94 having a mid-section 96 that extends between a radially outer portion 98 and a retaining leg 100. The body 94 may include an annular structure (i.e., a full ring hoop).

The retaining leg 100 is generally opposite the radially outer portion 98 and extends to an inner diameter portion 102. A retaining ring 104 may engage the inner diameter portion 102 of the second cover plate 82 to axially secure the second cover plate 82 to the rotor assembly 50. In one embodiment, the retaining ring 104 engages both the inner diameter portion 102 of the second cover plate 82 and a flange 106 of the rotor disk 56.

The body 94 axially extends between an inner face 108 (which faces toward the rotor disk 56) and an outer face 110 (which faces away from the rotor disk 56). Cavities 112 may extend between the inner face 108 and the root 76 of the blade 25 or rotor disk 56 of the rotor assembly 50.

The retaining leg 100 may include one or more radial retention features 114 that limit radial deflection between the second cover plate 82 and the rotor disk 56. In one embodiment, the retaining leg 100 extends from the body 94 such that the retention feature 114 engages an inner diameter surface 116 of the rotor disk 56 to provide radial interference between the second cover plate 82 and the rotor disk 56.

The second cover plate 82 may additionally include one or more seals 120, such as knife edge seals, that seal relative to a static structure 122. In one embodiment, the static structure 122 is part of an adjacent stator assembly (see for example, the stator assembly 52 of FIG. 2).

In one non-limiting embodiment, the radially outer portion 98 of the second cover plate 82 includes one or more surfaces 124, such as sealing surfaces, which are received against the radially inner portion 88 of the first cover plate 80 beneath the ledge 90. The surfaces 124 seal between the first cover plate 80 and the second cover plate 82. The radially outer portion 98 of the second cover plate 82 may apply a force FC against the first cover plate 80 in order to axially retain the first cover plate 80 against the blade 25. The radially outer portion 98 may abut against the ledge 90 to radially retain the first cover plate 80 in the radially inward direction. Accordingly, in one embodiment, the first cover plate 80 is axially retained by the second cover plate 82 and is radially retained by both the second cover plate 82 and the platform 75.

Figure 4A:
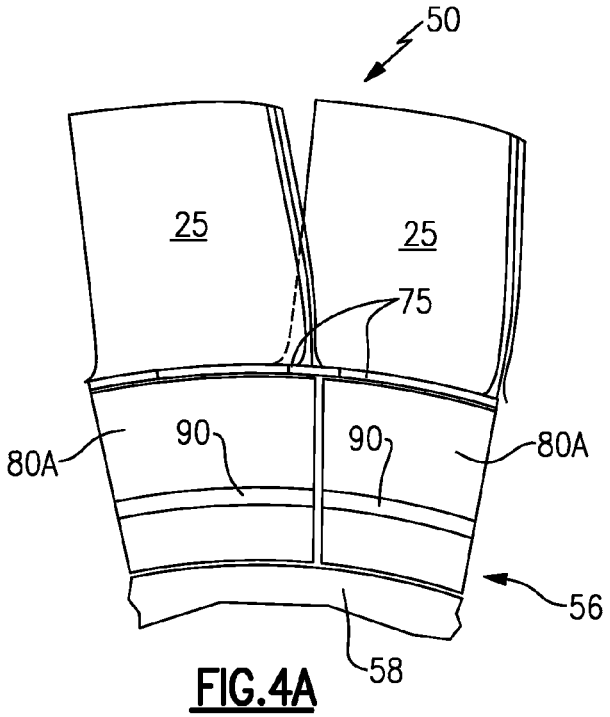
FIGS. 4A and 4B illustrate a segmented cover plate of a cover plate assembly.
Figure 4B:
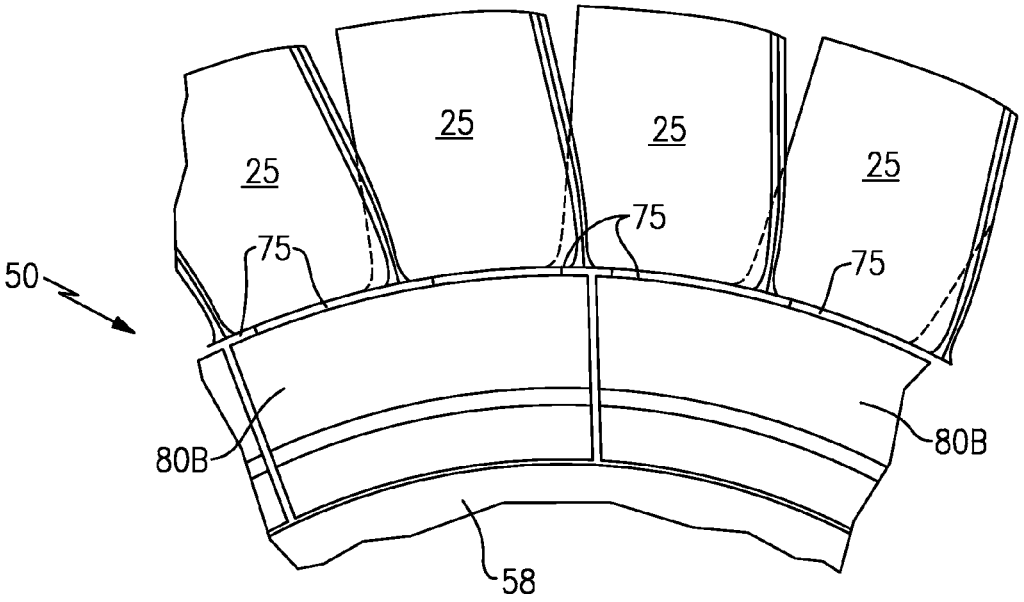

Exemplary segmented first cover plates 80 are illustrated by FIGS. 4A and 4B. Referring to FIG. 4A (with continued reference to FIG. 3), a single segmented cover plate 80A is positioned relative to each blade 25 of a rotor assembly 50. A plurality of segmented first cover plates 80A may be circumferentially positioned relative to one another at a position that is radially outward from a rim 58 of the rotor disk 56. Alternatively, as shown in FIG. 4B, a segmented first cover plate 80B may be positioned relative to a group of two or more blades 25. These embodiments are for illustration only and are not intended to limit this disclosure. The segmented, first cover plates 80 may include any size, shape or configuration.

Figure 5:
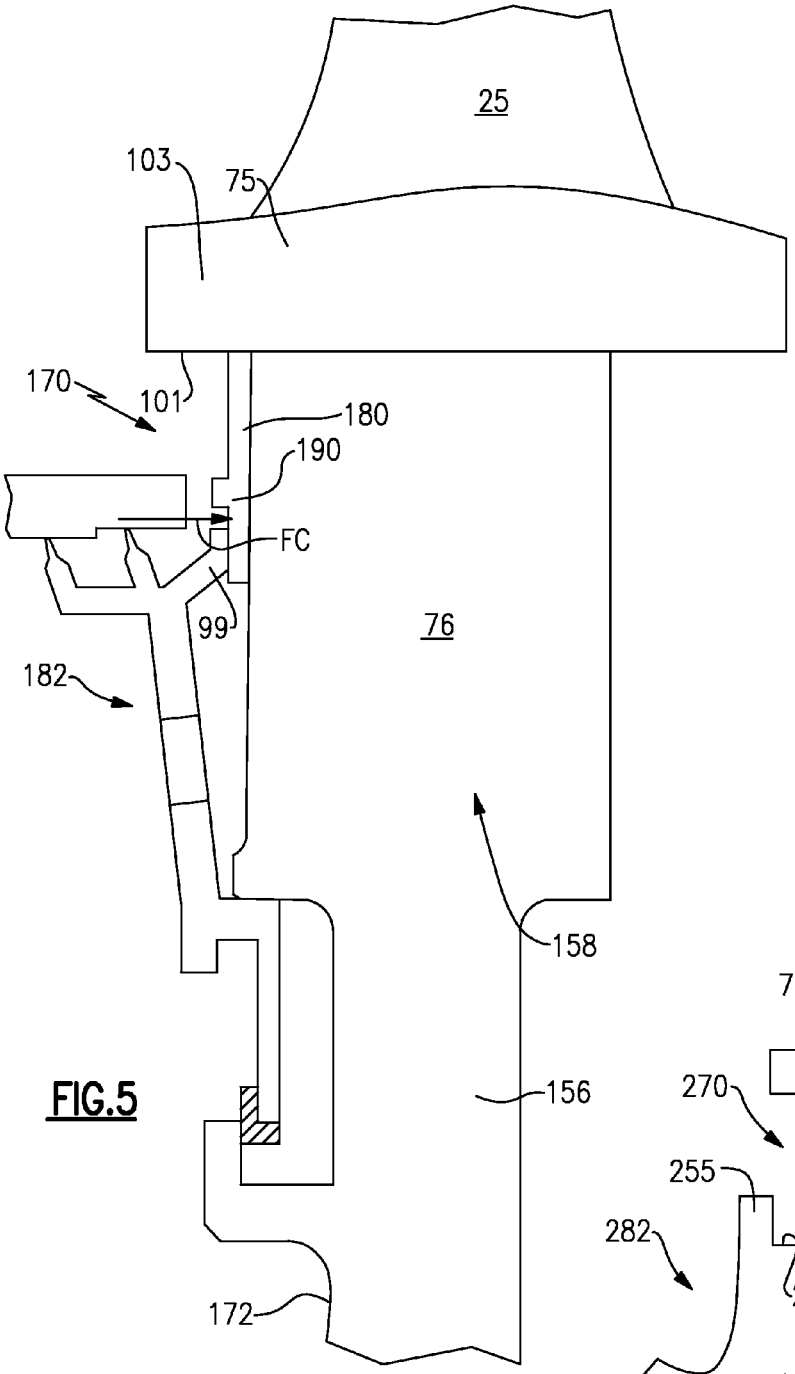
FIG. 5 illustrates another embodiment of a cover plate assembly.

FIG. 5 illustrates another exemplary cover plate assembly 170. In this disclosure, like reference numbers designate like elements where appropriate and reference numerals with the addition of 100 or multiples thereof designate modified elements that are understood to incorporate the same features and benefits of the corresponding original elements.

In this embodiment, the cover plate assembly 170 includes a first cover plate 180, which is segmented, and a second cover plate 182 that is a full hoop structure. The first cover plate 180 is positioned against the platform 75 and the root 76 of a blade 25 at a position radially outward of a rim 158 of the rotor disk 156. The second cover plate 182 extends radially inwardly from the first cover plate 180 along a surface 172 of the rotor disk 156.

The first cover plate 180 is axially retained against the blade 25 by the second cover plate 182. A leg 99 of the second cover plate 182 applies a force FC against the first cover plate 180 to axially secure the first cover plate 180 against the root 76. The first cover plate 180 may be radially retained by both the platform 75 of the blade 25 and the second cover plate 182. The first cover plate 180 abuts against an inner surface 101 of a platform ledge 103 to radially retain the first cover plate 180 in the radially outward direction. The second cover plate 182 may abut a ledge 190 of the first cover plate 180 to radially retain the first cover plate 180 in the radially inward direction.

Figure 6:
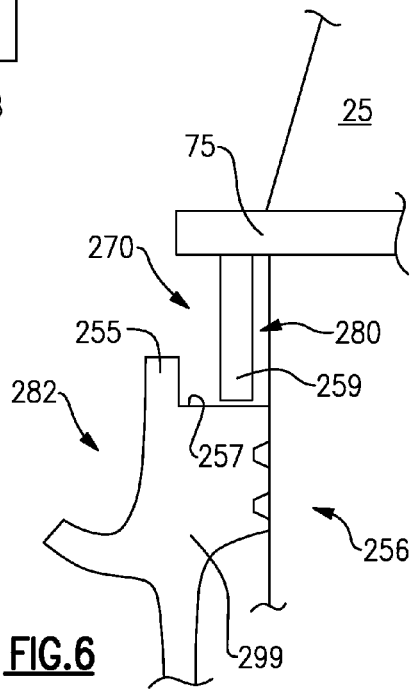
FIG. 6 illustrates yet another embodiment of a cover plate assembly.

FIG. 6 illustrates yet another cover plate assembly 270 that includes a first cover plate 280, which is segmented, and a second cover plate 282 that is a full hoop. In this embodiment, a leg 299 of the second cover plate 282 includes a lip 255 and a ledge 257. A portion 259, here a radially inner leg, of the first cover plate 280 may be axially trapped between a rotor disk 256 and the lip 255 and may be radially trapped between a platform 75 of a blade 25 and the ledge 257. In this manner, the first cover plate 280 is both axially and radially retained.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A cover plate assembly, comprising:

a first cover plate;

a second cover plate in contact with a portion of said first cover plate to at least axially retain said first cover plate;

wherein said first cover plate is segmented and said second cover plate is a full hoop; and wherein a radially outer portion of said first cover plate abuts a platform of a blade, and said radially outer portion is received within a groove of said platform.

2. The cover plate assembly as recited in claim 1, wherein said cover plate assembly is part of a turbine assembly or a compressor assembly.

3. The cover plate assembly as recited in claim 1, wherein said first cover plate includes a body that extends between said radially outer portion and a radially inner portion and a ledge or tab located between said radially outer portion and said radially inner portion.

4. The cover plate assembly as recited in claim 1, wherein said second cover plate includes a body having a mid-section that extends between a radially outer portion and a retaining leg.

5. The cover plate assembly as recited in claim 1, wherein said second cover plate includes a radially outer portion that applies a force against a radially inner portion of said first cover plate to axially retain said first cover plate.

6. The cover plate assembly as recited in claim 1, wherein a portion of said first cover plate is axially trapped by a lip of said second cover plate.

7. The cover plate assembly as recited in claim 1, wherein one of said first cover plate and said second cover plate abuts a ledge or tab of the other of said first cover plate and said second cover plate to radially retain said first cover plate.

8. A gas turbine engine, comprising:

a rotor disk;

a blade that extends from said rotor disk;

a first cover plate positioned relative to a portion of said blade; and a second cover plate positioned relative to said rotor disk and extending radially inward from said first cover plate;

a retaining ring between said cover plate and said rotor disk the retaining ring having a step-shaped cross section;

wherein said first cover plate is positioned relative to a platform of said blade, and a radially outer portion of said first cover plate is received within a groove of said platform.

9. The gas turbine engine as recited in claim 8, wherein said first cover plate is a segmented cover plate and said second cover plate is a full hoop cover plate.

10. The gas turbine engine as recited in claim 9, wherein said first cover plate is radially outward of a rim of said rotor disk.

11. The gas turbine engine as recited in claim 10, wherein said second cover plate includes one or more knife edge seals that seal relative to an adjacent stator assembly.

12. The gas turbine engine as recited in claim 11, wherein said first cover plate is sandwiched between said rotor disk and said second cover plate at a location radially outward of said one or more knife edge seals with respect to an engine longitudinal axis.

13. The gas turbine engine as recited in claim 12, wherein said second cover plate includes a radially outer portion that applies a force against a radially inner portion of said first cover plate to axially retain said first cover plate.

14. The gas turbine engine as recited in claim 13, wherein second cover plate includes a radial retention feature that abuts against an inner diameter surface of said rotor disk to provide radial interference between said second cover plate and said rotor disk, said radial retention feature is radially inward of said one or more knife edge seals with respect to said engine longitudinal axis, and said retaining ring is situated axially between an inner diameter portion of said second cover plate and a radially extending flange of said rotor disk with respect to said engine longitudinal axis.

15. The gas turbine engine as recited in claim 8, wherein said first cover plate is radially outward of a rim of said rotor disk.

16. A method, comprising:

axially retaining a first cover plate relative to a blade of a gas turbine engine with a second cover plate;

radially retaining the first cover plate with a portion of the blade;

wherein the first cover plate is a segmented cover plate and the second cover plate is a full hoop cover plate; and wherein the step of radially retaining the first cover plate includes positioning a portion of the first cover plate into a groove of a platform of the blade.

17. The method as recited in claim 16, wherein the step of axially retaining includes exerting a force against the first cover plate with a portion of the second cover plate or axially trapping the first cover plate with a lip of the second cover plate.

18. The method as recited in claim 16, wherein the step of radially retaining the first cover plate includes abutting a portion of one the first cover plate and the second cover plate with a portion of the other of the first cover plate and the second cover plate.

* * * * *